US005804825A

United States Patent [19]

Schuler

[11] Patent Number: 5,804,825

[45] Date of Patent: Sep. 8, 1998

[54] FIRE DETECTOR HAVING WIDE-RANGE SENSITIVITY

[75] Inventor: Frederick J. Schuler, Lakeville, Minn.

[73] Assignee: Detector Electronics Corporation, Minneapolis, Minn.

[21] Appl. No.: 852,981

[22] Filed: May 7, 1997

[51] Int. Cl.[6] ..... G08B 17/12

[52] U.S. Cl. ..... 250/339.15; 340/578

[58] Field of Search ..... 340/578, 511; 250/372, 339.15, 339.02, 339.01

[56] References Cited

U.S. PATENT DOCUMENTS

| | | | |
|---|---|---|---|
| 4,357,534 | 11/1982 | Ball . | |
| 4,694,172 | 9/1987 | Powell et al. | 250/339.15 |
| 4,785,292 | 11/1988 | Kern et al. . | |
| 4,866,420 | 9/1989 | Meyer, Jr. . | |
| 5,373,159 | 12/1994 | Goldenberg et al. . | |
| 5,625,342 | 4/1997 | Hall et al. | 250/339.15 |

FOREIGN PATENT DOCUMENTS

| | | | |
|---|---|---|---|
| 2281615 | 3/1995 | United Kingdom | 340/578 |

OTHER PUBLICATIONS

Feldman, *High–Speed Low–Power Signal Sigma–Delta Modulators for Digital Wireless Communications Systems,* 04.Integrated Circuits, http://hera.eecs.berkeley.edu/~ilp-book/96.04.ic.html, Apr. 13, 1997 (2pgs.).

*Primary Examiner*—Edward J. Glick
*Assistant Examiner*—Darren M. Jiron
*Attorney, Agent, or Firm*—Merchant, Gould, Smith, Edell, Welter & Schmidt, P.A.

[57] ABSTRACT

A radiation detector having wide-range sensitivity is provided. In accordance with one embodiment of the invention, a radiation detector for detecting a radiation condition is provided. The radiation detector includes a plurality of sensors each of which detect radiation in a spectral band and output an analog signal in response to the amount of radiation in the spectral band, a converter system associated with each of the sensors for converting each analog signal to a digital signal, and a processor coupled to the converter system for using the digital signals to output a detection signal. The converter system has a sensitivity range which includes a minimum magnitude and a maximum magnitude of the analog signals. The processor can detect the radiation condition in an environment which concurrently induces the minimum magnitude in the analog signal of one of the sensors, and the maximum magnitude in the analog signal of a different one of the sensors. The radiation detector may, for example, be a fire detector which detects fire conditions such as unwanted or potentially dangerous fires or flames.

19 Claims, 2 Drawing Sheets

FIRE DETECTOR HAVING WIDE-RANGE SENSITIVITY

FIELD OF THE INVENTION

The present invention relates generally to radiation detectors and, more particularly, to a fire detector having wide-range sensitivity.

BACKGROUND OF THE INVENTION

Radiation detectors are generally used for detecting certain radiation conditions and to discriminate between these conditions and other sources of radiation which are not desired to be detected. One common radiation detector is a fire detector. Fire detectors are used in a variety of industries for detecting certain fire conditions, such as unwanted or potentially dangerous fires or flames. For example, fire detectors are used in the oil industry to detect fire conditions on oil platforms and refineries. In these environments, a fire detector must be able to discriminate between fire conditions and other sources of radiation such as sunlight, artificial light, hot surfaces, and so forth. Fire detectors are also used in the military industry, for example, where the fire detector must be able to discriminate between an exploding ammunition round and a fire condition, such as a fire or explosion set-off by the ammunition round.

Fire detectors (and radiation detectors) typically include one or more sensors each of which receives radiation in a given wavelength or spectral band and generates an analog signal dependent upon the amount of radiation in the spectral band, an analog-to-digital converter (ADC Converter) which converts each analog signal to a digital signal and circuitry which uses the digital signal(s) to detect a presence of a fire (radiation) condition. One common type of fire detector employs a single sensor, the output of which is compared to a threshold to determine the presence of a fire condition. When the amplitude of the sensor output exceeds the threshold, regardless of the radiation source, the presence of a fire condition is indicated.

Another common type of fire detector employs a number of sensors each detecting radiation in a spectral band. Typically, the concurrent presence or absence of radiation in each spectral band and the relative magnitudes thereof are used to detect the presence of fire conditions. In these multiple sensor systems, automatic gain control (AGC) or gain ranging is typically used to adjust the analog output signals of the sensors for input to the ADC converter It should be appreciated that proper radiation detection in each spectral band is important to the accuracy of the detection circuitry. An inaccurate reading in one or more spectral bands can result in a false detection of a fire condition or a failure to detect an existing fire condition.

SUMMARY OF THE INVENTION

The present invention generally provides a radiation detector having wide-range sensitivity. The present invention generally overcomes the problems identified in conventional radiation detectors, such as fire detectors, which cause false detection signals or the inability to detect a fire condition.

In accordance with one embodiment of the invention, a radiation detector for detecting a radiation condition is provided. The radiation detector includes a plurality of sensors each of which detect radiation in a spectral band and output an analog signal in response to the amount of radiation in the spectral band, a converter system associated with each of the sensors for converting each analog signal to a digital signal, and a processor coupled to the converter system for using the digital signals to output a detection signal. The converter system has a sensitivity range which includes a minimum magnitude and a maximum magnitude of the analog signals. The processor can detect the radiation condition in an environment which concurrently induces the minimum magnitude in the analog signal of one of the sensors, and the maximum magnitude in the analog signal of a different one of the sensors. The radiation detector may, for example, be a fire detector which detects fire conditions such as unwanted or potentially dangerous fires or flames.

The above summary of the present invention is not intended to describe each illustrated embodiment. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
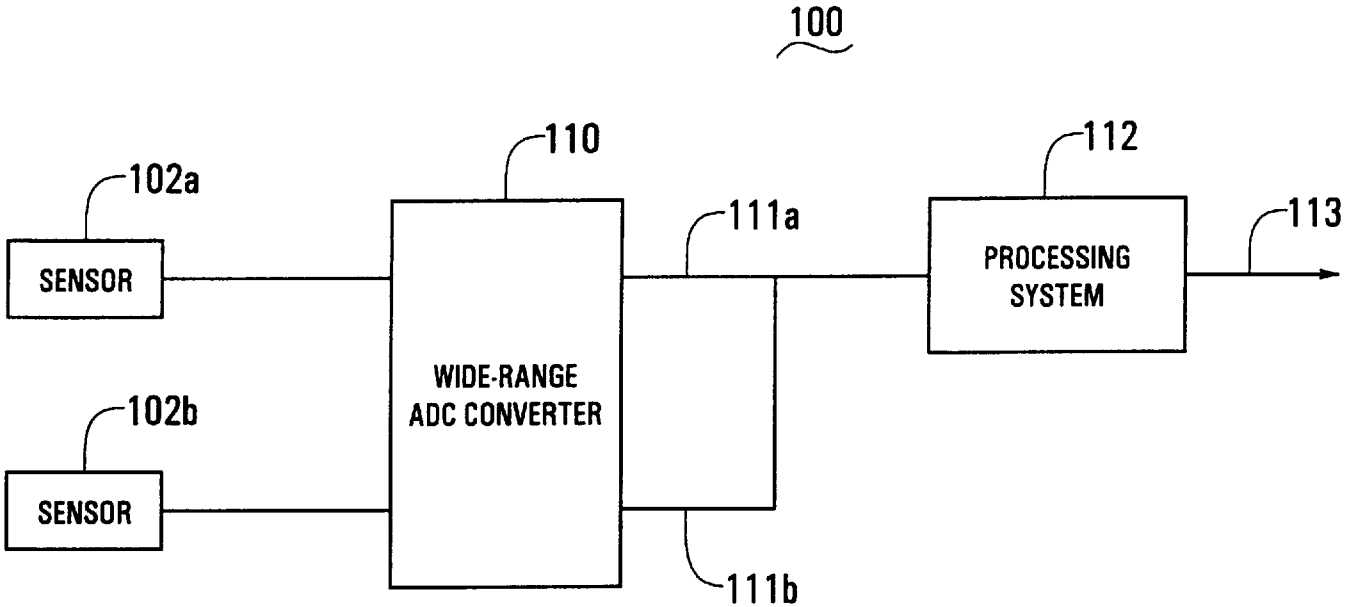
FIG. 1 is a block diagram of an exemplary radiation detector in accordance with one embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

The present invention generally relates to radiation detectors having wide-range sensitivity and, more particularly, to fire detectors having wide-range sensitivity. While the present invention is not so limited, an appreciation of various aspects of the invention will be gained through a discussion of the examples provided below.

Fire detection systems often include two or more sensors each of which sense radiation in a particular spectral band and output an analog signal in response to the amount of radiation detected in the particular spectral band. The analog output signals are generally provided to an analog-to-digital converter (ADC converter) which converts the analog signals to digital signals. The digital signals are used by processing circuitry to develop a detection signal indicating the presence or absence of a fire condition. Fire detection systems employing two or more sensors (including their processing circuitry) are illustrated in Goldenberg et al., U.S. Pat. No. 5,373,159, entitled "Method For Detecting A Fire Condition" and Ball, U.S. Pat. No. 4,357,534, entitled "Fire And Explosion Detection."

One approach to processing the analog output signals includes using automatic gain control (AGC) circuitry or gain ranging circuitry (both of which are herein generally referred to as gain circuitry) to bring the analog output signal levels within the range of the ADC converters. In conjunction with the present invention, it has been determined that fire detection systems employing such gain circuitry can give false detection signals (e.g., a positive fire detection signal in the absence of a fire condition or a negative detection signal in the presence of a fire condition) under certain conditions. These conditions arise, for example, when the total radiation within the spectral band of one or more of the sensors is relatively small or large as compared to the amount of radiation in the spectral bands which would produce an ideal analog signal for input to the ADC converter.

King et al., U.S. patent application Ser. No. 08/852,086 entitled "FIRE DETECTION METHOD AND APPARATUS USING OVERLAPPING SPECTRAL BANDS," filed May 7, 1997, the contents of which are herein incorporated by reference, illustrates the advantages of particular spectral bands for multiple-sensor fire detector systems. As discussed therein, radiation sources are characterized by particular radiation emission, and the selection of spectral bands for the sensors may be chosen to enhance discrimination of these radiation sources. In certain circumstances, it is important to evaluate a radiation environment which includes a relatively small amount of radiation in one spectral band as compared to another spectral band when monitoring for a fire condition. The relative magnitudes of the radiation in each spectral band is used to facilitate detection of the fire condition. In such circumstances, it is important to accurately determine the magnitude in each spectral band.

In fire detector systems employing gain circuitry, the gains for each analog output signal are typically linked together so that the gains change at the same time by the same amount. In these systems, where the magnitude of one analog output signal is sufficiently greater than another output signal (such as where the environment which includes a relatively small amount of radiation in one spectral band as compared to another spectral band), the gain circuitry could adjust the signal level at the ADC input for the larger analog signal to exceed the high end of its associated ADC converter and/or the gain circuitry could adjust the signal level at the ADC input for the second analog output signal to fall below the low range of its associated ADC converter. In either instance, information otherwise available in one of the analog output signals is lost. The lost information can significantly impact the value of any calculations performed using the analog output signals and cause false detection signals.

FIG. 1 is an exemplary radiation detector system 100 having a wide-range ADC converter system 110 in accordance with one exemplary embodiment of the present invention. The wide-range ADC converter system 110 generally overcomes the problems identified in conventional systems. The radiation detection system 100 generally includes two or more sensors 102*a–b* for detecting radiation in certain spectral bands and outputting analog signals 103*a–b* in response to the detected radiation. The wide-range ADC converter system 110 converts the analog signals 103*a–b* into digital signals 111*a–b*, and a processing system 112 processes the digital signals 111*a–b* to determine the presence or absence of a radiation condition. A detection signal 113 is output based on the calculations.

Each of the sensors 102*a–b* detect radiation over a given spectral band and output an analog signal having a magnitude dependent upon the amount of detected radiation within the spectral band. Each analog signal 103*a–b* has an output range which spans between a minimum magnitude (typically dependent upon the noise level of the sensor) and a maximum magnitude (typically dependent upon the power supply for the sensor).

The wide-range ADC converter system 110 generally has a sensitivity range which is at least as wide as the magnitude range of the analog signals 103*a–b*, that is the lower sensitivity limit of the converter system 110 is less than or equal to the minimum magnitude of the analog signals 103*a–b* and the upper sensitivity limit of the converter system 110 is equal to or greater than the maximum magnitude of the analog signals 103*a–b*. For example, where the analog signals 103*a–b* have a minimum magnitude of about 1–2 microvolts and a maximum magnitude of 5 volts, the converter system 110 may have a sensitivity range ranging from one-third microvolts to slightly more than 5 volts.

The wide-range ADC converter system 110 may, for example, be a single ADC converter having multiple input and output channels. Each input channel may receive a respective one of the analog signals 103*a–b* and each output channel may output a corresponding digital signal. In other embodiments, as will be discussed more fully below, the wide-range ADC converter system 110 may include, for example, a plurality of wide-range ADC converters each of which is associated with one of the sensors 102*a–b*.

The wide-range converter system 110, by having a sensitivity range greater than the magnitude range of the analog signals it receives, eliminates the need for gain circuitry and the problems associated therewith. In particular, the wide-range converter system 110 can process analog signals 103*a–c* without loss of information even, for example, in an environment which has a radiation emission spectrum which induces a sensor output signal at its maximum magnitude and another sensor output signal at or near its minimum magnitude. This enhances the accuracy of the radiation detection system 100.

The use of the wide-range converter system 110 may also increase the response time of the radiation detection system 100 as compared to systems employing gain circuitry. Radiation detection system employing gain circuitry generally adjust the magnitude of sensor analog output signals to be within the range of their associated ADC converter. To do this, the gain circuitry measures the magnitude of the analog output signal level, compares the magnitude to a reference or ideal level, and changes the gain of the analog output signal to bring the analog output signal level closer to the reference or ideal level at the ADC converter input. While the gain circuitry changes gain, processing of the analog output signals for the detection of a fire condition is typically suspended until the system acquires a stable analog output signal level. After acquiring a stable analog output signal level, the new signal level is compared to a reference level to determine whether the new signal level is within a desired tolerance. If the new signal level is within tolerance, processing to detect a fire condition resumes; otherwise, the gain is changed again. As a result, response time of radiation detection systems employing gain circuitry may be inadequate. The use of a wide-range converter system can improve response time.

Figure 2:
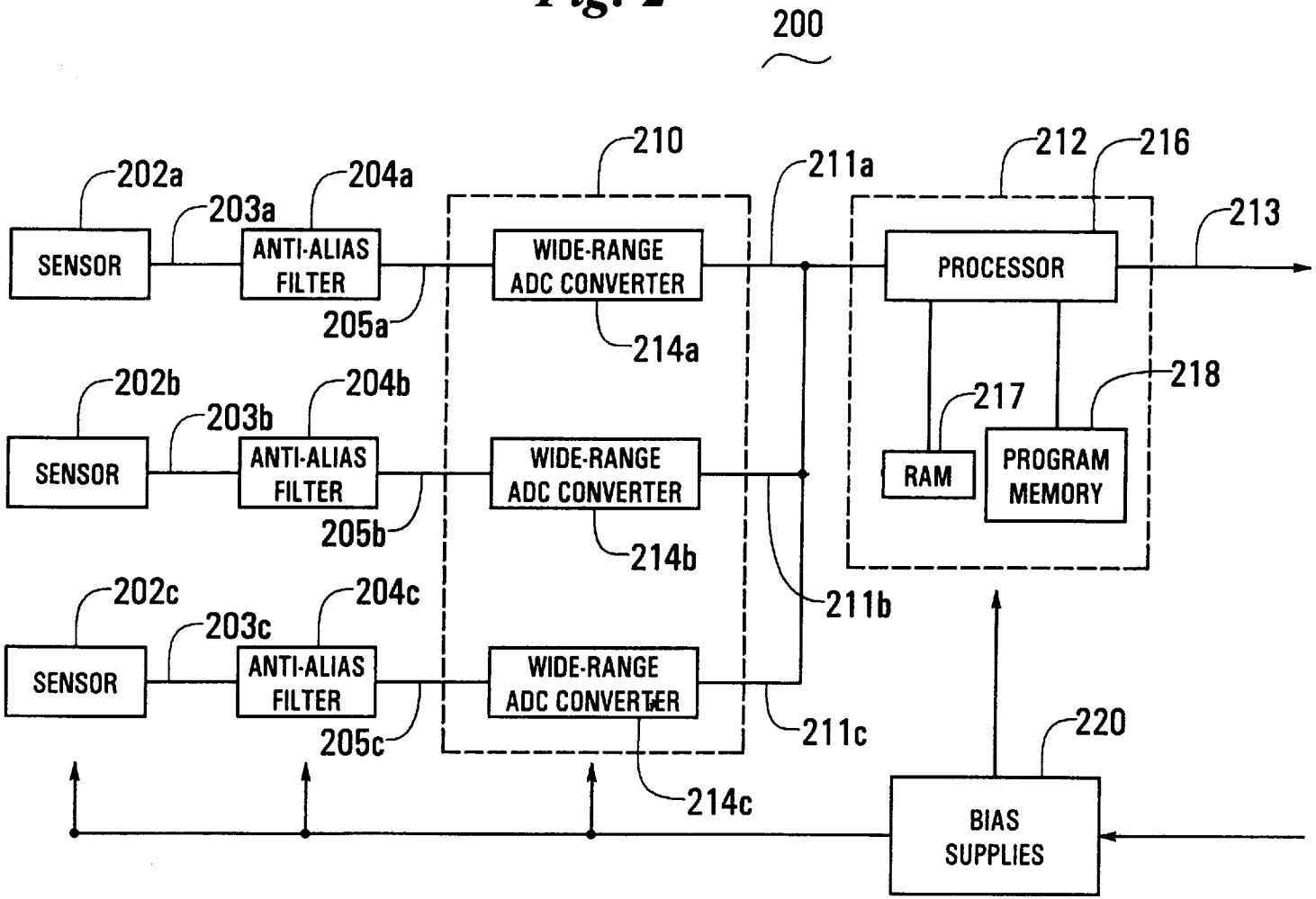
FIG. 2 is an exemplary fire detector in accordance with yet another embodiment of the present invention.

As should be appreciated by those skilled in the art, the radiation detection system 100 discussed above may be used detect a wide variety of radiation conditions, including but not limited sound or noise conditions, infrared conditions, such as fire conditions, ultraviolet conditions, and so forth. In FIG. 2, there is illustrated an exemplary fire detector 200 for detecting the presence or absence of a fire condition as one example of a radiation detector in accordance with one embodiment of the present invention. The fire detector 200 in general and the subcomponents thereof are provided by way of example and not of limitation. Those skilled in the art will readily recognize various modifications and/or optimizations of the fire detector 200 and its subcomponents. These modifications and optimizations are intended to be covered by the present invention.

The fire detector 200 of FIG. 2 generally includes three sensors 202*a–c*, a wide-range ADC converter system 210 for converting the output signals 203*a–c* of the sensors 202*a–c* to digital signals 211*a–c*, and a processing system 212 for processing the digital signals 211*a–c* and outputting a fire detection signal 213 indicative of the presence or absence of a fire condition. As will be discussed further below, the fire detector 200 may further include anti-alias filters 204*a–c* for filtering out frequencies in the analog signals 203*a–c* above a cut-off frequency. As will be appreciated by those of skill in the art, each of the components of the fire detector 200 may be powered by an appropriate bias supply 210. Suitable bias supplies for the sensors 202*a–c* include ±15 Volts for the anti-alias filters 204*a–c*, and ±5 Volts for the converter system 210 and processing system 212.

Each of the sensors 202*a–c* generally sense radiation in a particular spectral band and output an analog signal having a magnitude dependent upon the amount of radiation in the particular spectral band. The particular type of sensor and spectral band of the sensor may be suitably selected in consideration of the environment in which the sensor is employed. Typically, fire detector sensors operate in the infrared spectrum. In one exemplary embodiment, sensor 202*a* has a spectral band from about 3.95 to 4.10 microns, sensor 202*b* a spectral band from about 4.45 to 4.6 microns, and sensor 202*c* a spectral band from about 4.45 to 4.8 microns. This particular spectral band arrangement, by substantially aligning the edge wavelengths of the spectral bands of two of the sensors, provides more accurate fire detection as more fully described in the above-referenced U.S. patent application entitled "FIRE DETECTION METHOD AND APPARATUS USING OVERLAPPING SPECTRAL BANDS."

Each of the analog signals 203*a–c* output from the sensors 202*a–c* has a range which spans from a minimum magnitude to a maximum magnitude. The minimum magnitude is typically dependent upon the noise level of the respective 202*a–c* sensor and may, for example, be 1–2 microvolts. This minimum magnitude can for example provide a confidence level with a particular certainty in the detection signal. The maximum magnitude for a particular analog signal is typically dependent upon the power supply to the associated 202*a–c* sensor and may, for example, be about 5 volts.

In the exemplary embodiment, one of the anti-alias filters 204*a–c* is coupled between each one of the sensors 202*a–c* and the wide-range ADC converter system 210. The anti-alias filters 204*a–c* generally receive the analog signals 203*a–c*, filter out a frequency range above a desired cut-off frequency, and output a filtered analog signal 205*a–c*. The cut-off frequency of a particular anti-alias filter may be suitably selected in consideration of the frequency spectrum of the received analog signal and the aliasing effects desired to be avoided. A cut-off frequency of about 6 Hertz would typically be suitable for most fire detectors. In alternate embodiments, anti-alias filters may be incorporated within the wide-range converter system 210.

The exemplary wide-range ADC converter system 210 includes three wide-range ADC converters 214*a–c*, each of which are associated with a respective one the sensors 202*a–c* and receive the filtered analog signal 205*a*, 205*b* or 205*c* of the associated sensor. Each ADC converter 214*a–c* has a sensitivity range at least as wide as the magnitude range of the analog signal 205*a–c* received from the associated sensor 202*a–c*. In the exemplary embodiment, the sensitivity range of each ADC converter 214*a–c* ranges from about one-third of a microvolt to slightly over 5 volts. Suitable ADC converters 214*a–c* include predictive linear coders or sigma delta converters having, for example, 22–24 bit resolution and a low pass filter of the sinc function to the third power. While this particular embodiment illustrates a wide-range ADC converter system having one ADC converter associated with each sensor, the invention is not so limited. A combination of or all of the sensors may be coupled to a single multichannel ADC converter, for example.

The digital signals 211*a–c* output from the ADC converters 214*a–c* are provided to a processing system 212 and are used to determine the presence or absence of a fire condition. The exemplary processing system 212 includes a processor 216 coupled to a memory arrangement which includes random access memory (RAM) 217 and program memory 218. One suitable processing system includes a 32 bit processor, such as a Motorola 68331, and a 64 k×16 program memory and 32 k×16 RAM. The processing system 212 may process the digital signals 211*a–c* from the sensor 202*a–c* in a wide variety of manners. Suitable processing techniques include those disclosed in Schuler, U.S. patent application Ser. No. 08/779,723, filed Jan. 7, 1997, and the above-referenced U.S. patent application entitled "FIRE DETECTION METHOD AND APPARATUS USING OVERLAPPING SPECTRAL BANDS," both of which are assigned to the assignee of the present invention.

The wide-range converter system 210, by having a sensitivity range greater than the magnitude range of the analog signals it receives, eliminates the need for gain circuitry and the problems associated therewith. For example, the wide-range converter system 210 can process analog signals 203*a–c* without loss of information even in an environment which has a radiation emission spectrum which induces a sensor output signal at its maximum magnitude and another sensor output signal at or near its minimum magnitude. This enhances the accuracy of the fire detector 200.

The use of the wide-range converter system 210 may also increase the response time of the fire detector 200 as compared to fire detection systems employing gain circuitry, in a similar manner as discussed above.

While the illustrated embodiments illustrate the use of two and three sensors and the invention is particularly suited to radiation detection systems employing two or more sensors, it should be appreciated that any number of sensors, including detection systems with only one sensor or more than three sensors, can benefit from the present invention and are intended to be covered by the present invention.

As noted above, the present invention is applicable to a wide variety of radiation detectors, including, in particular, fire detectors. Accordingly, the present invention should not be considered limited to the particular examples described above, but rather should be understood to cover all aspects of the invention as fairly set out in the attached claims. Various modifications as well as numerous equivalent structures to which the present invention may be applicable will be readily apparent to those of skill in the art to which the present invention is directed upon review of the present specification. The claims are intended to cover such modifications and structures.

What is claimed is:

1. A fire detector for detecting a fire condition, comprising:

a plurality of sensors, each sensor detecting radiation in a corresponding spectral band and outputting an analog signal in response to the detected radiation, the analog signals having a minimum magnitude and a maximum magnitude;

a converter system associated with the sensors for converting each analog signal to a digital signal, the converter system having a sensitivity range including the minimum magnitude and the maximum magnitude of the analog signals; and a processor coupled to the converter system for using each digital signal to output an accurate detection signal for a fire condition in an environment which concurrently induces the minimum magnitude in the analog signal of one of the sensors and the maximum magnitude in the analog signal of a different one of the sensors.

2. The fire detector of claim 1, further including at least one anti-aliasing filter associated with at least one of the sensors for filtering out a frequency range of the analog signal of the at least one of the sensors above a cut-off frequency.

3. The fire detector of claim 2, wherein the cut-off frequency is about 6 Hz.

4. The fire detector of claim 2, wherein the anti-aliasing filter is coupled between the respective sensor and the converter system.

5. The fire detector of claim 1, wherein the minimum magnitude of the analog signals is a noise level of at least one of the respective sensors.

6. The fire detector of claim 1, wherein the minimum magnitude is a certain magnitude of the analog signals which provides a confidence level with a particular certainty in the detection signal.

7. The fire detector of claim 1, wherein the sensitivity range of the converter system ranges from less than 1 microvolt to greater than 5 volts.

8. The fire detector of claim 7, wherein the sensitivity range of the converter system ranges from about ⅓ microvolts to greater than 5 volts.

9. The fire detector of claim 1, wherein the converter system includes a plurality of converters, each of the converters being coupled to a respective one of the sensors for converting the analog signal of the respective sensor to a digital signal, each converter having a sensitivity range at least as wide as the range of the analog signal of the respective sensor.

10. The fire detector of claim 1, wherein the converter system includes a single multiplexing converter having a plurality of input and output channel pairs, each input channel receiving the analog signal of a respective one of the sensors and each output channel outputting the digital signal of the received analog signal.

11. The fire detector of claim 1, wherein the converter system includes a sigma-delta converter.

12. The fire detector of claim 11, wherein the sigma-delta converter has 22–24 bit resolution.

13. The fire detector of claim 1, wherein the plurality of sensors includes two or more sensors.

14. The fire detector of claim 1, wherein the plurality of sensors includes three or more sensors.

15. A radiation detector for detecting a radiation condition, comprising:

a plurality of sensors, each sensor detecting radiation in a corresponding spectral band and outputting an analog signal in response to the detected radiation, the analog signals having a minimum magnitude and a maximum magnitude;

a converter system associated with the sensors for converting each analog signal to a digital signal, the converter system having a sensitivity range including the minimum magnitude and the maximum magnitude of the analog signals; and a processor coupled to the converter system for using each digital signal to output an accurate detection signal for a radiation condition in an environment which concurrently induces the minimum magnitude in the analog signal of one of the sensors and the maximum magnitude in the analog signal of a different one of the sensors.

16. The radiation detector of claim 15, further including at least one anti-aliasing filter associated with at least one of the sensors for filtering out a frequency range of the analog signal of the at least one of the sensors above a cut-off frequency.

17. The radiation detector of claim 15, wherein the minimum magnitude of the analog signals is a noise level of at least one of the respective sensors.

18. The radiation detector of claim 15, wherein the minimum magnitude is a certain magnitude of the analog signals which provides a confidence level with a particular certainty in the detection signal.

19. The radiation detector of claim 15, wherein the converter system includes a plurality of converters, each of the converters coupled to a respective one of the sensors for converting the analog signal of the respective sensor to a digital signal, each converter having a sensitivity range at least as wide as the range of the analog signal of the respective sensor.

* * * * *